US005934926A

United States Patent [19]

Gabrisko, Jr. et al.

[11] Patent Number: 5,934,926

[45] Date of Patent: Aug. 10, 1999

[54] ELECTRICAL CONNECTOR SYSTEM WITH PRE-STAGED FEATURE

[75] Inventors: Ronald E. Gabrisko, Jr.; Randy L. Fink, both of Warren, Ohio; Phillip D. Winters, Peru, Ind.

[73] Assignee: Packard Hughes Interconnect Company, Irvine, Calif.

[21] Appl. No.: 09/020,218

[22] Filed: Feb. 6, 1998

[51] Int. Cl.[6] ..... H01R 13/627

[52] U.S. Cl. ..... 439/364; 439/357; 439/358

[58] Field of Search ..... 439/350, 364, 439/381, 374, 378, 357, 358

[56] References Cited

U.S. PATENT DOCUMENTS

| | | | |
|---|---|---|---|
| 5,376,016 | 12/1994 | Inaba et al. | 439/364 |
| 5,378,168 | 1/1995 | Sumida | 439/358 |
| 5,685,729 | 11/1997 | Reider et al. | 439/206 |
| 5,775,953 | 7/1998 | Yamanashi et al. | 439/357 |

*Primary Examiner*—Steven L. Stephan
*Assistant Examiner*—Hal Moon Hyeon
*Attorney, Agent, or Firm*—Cary W. Brooks; Patrick M. Griffin

[57] ABSTRACT

An electrical connector system including a first and second connector housing wherein the first connector housing made from a die cast metal. The first connector housing includes a base portion having a plurality of through holes formed therein and a shroud extending from the base portion and surrounding the plurality of through holes. The shroud forming a socket to receive projections extending from the second connector housing in the mating direction of the connector housings, and wherein the first connector housing is connected to an electronic device having a plurality of electrical terminal pins extending through the through holes for engaging female terminals carried in the projections of the second connector housing. An insert member is snap fitted into the first connector housing and includes an elongated flexible locking finger extending in the mating direction of the connector housings and having a locking shoulder extending generally perpendicular to the longitudinal axis of locking finger for lockable engagement with a lock shoulder on the second connector housing so that the first and second connector housings may be temporarily connected together in a pre-staged position. The first and second connector housings having a primary lock mechanism that may be engaged, after the connector housings are coupled together in the pre-states position, to coupled the first and second connector housings in a final fixed position wherein the electrical terminal to pins are fully engaged with the female terminals.

10 Claims, 3 Drawing Sheets

ELECTRICAL CONNECTOR SYSTEM WITH PRE-STAGED FEATURE

TECHNICAL FIELD

This invention relates to electrical connector systems, and more particularly to an electrical connector system for making electrical connection to an electronic device such as a printed circuit board.

BACKGROUND OF THE INVENTION

Referring now to FIG. 1, a prior art electrical connector systems includes a first die cast aluminum connector housing 10 that is mounted to a printed circuit board (not shown) for attaching wire harnesses attached to a second connector housing (not shown) to the printed circuit board for transmitting electrical signals to and from the circuitry of the printed circuit board. Various features of the prior art are not shown because the features are not necessary to understand the problem in the prior art. The die cast housing 10 includes a base portion 12 having a plurality of through hole cavities (not shown) through which electrical connector pins extend from the printed circuit board. A shroud 16 extends upward from the base portion 16 immediately surrounding the cavities and is constructed and arranged to receive the male portion of a second connector housing (not shown). A mounting bridge 18 also extends from the base 12 in the same direction as the shroud 16 and is positioned generally in the middle of the socket defined by the shroud 16. The mounting bridge 18 includes a threaded passage 17 for receiving a bolt (not shown) that extends through the second connector housing and into the mounting bridge to firmly connect together the first and second connector housings.

However, before the first and second connector housings are bolted together, the housings must first be pre-staged so that the electrical pins extending from the printed circuit board are properly aligned with mating female terminals in the second connector housing to prevent damage to or bending of the electrical pins. To accomplish this, the outer surface of the shroud 16 has a lock ramp 20 formed therein. The lock ramp 20 on the shroud mates with a locking member on the second connector housing to temporarily hold the first and second connector housings together while a more permit fastening means, such as a bolt, is used to fix the housings together in a final position wherein the connectors and the terminals are fully mated. Alignment features on the two housings assure that the housings are properly positioned before the housings can be temporarily locked in the pre-stage position and permanently fix together by the bolt. However, due to the configuration of the aluminum housing, the lock ramp cannot be die cast but must be machined into the outer surface of the shroud 16 after the die casting has been produced. This provides additional cost and labor.

The present invention provides alternatives to and advantages over the prior art.

SUMMARY OF THE INVENTION

An electrical connector system according to the present invention includes a first and second connector housing wherein the first connector housing is made from a die cast metal. The first connector housing includes a base portion having a plurality of through holes formed therein and a shroud extending from the base portion and surrounding the plurality of through holes. The shroud defines a socket to receive projections extending from the second connector housing in the mating direction of the connector housings. The first connector housing is connected to an electronic device having a plurality of electrical terminal pins extending through the through holes for engaging female terminals carried in the projections of the second connector housing. An insert pre-stage locking member, preferably made of plastic, is snap fitted into the first connector housing and includes an elongated flexible locking finger extending in the mating direction of the connector housings and having a locking shoulder extending generally perpendicular to the longitudinal axis of locking finger for lockable engagement with a lock shoulder on the second connector housing so that the first and second connector housings may be temporarily connected together in a pre-staged position. The first and second connector housings having a primary lock mechanism that may be engaged, after the connector housings are coupled together in the pre-staged position, to coupled the first and second connector housings in a final position wherein the electrical terminal pins are fully engaged with the female terminals. Thus, the present invention overcomes the drawback of the prior art that required the costly and labor intensive machining of a lock ramp in the outer surface of the metal connector shroud because the lock ramp could not be produced in the die casting process.

In another embodiment of the invention, the insert pre-stage locking member further includes a first block member having a plurality of holes formed therein each for receiving an electrical connector pin, and wherein the block member includes lock arms extending therefrom for engaging a lock shoulder formed in the die cast metal housing to secure the insert in the first housing.

In another embodiment of the invention, the first connector housing includes a pair of elongated through holes separated by a beam, and wherein the insert pre-stage locking member further includes a second block member also having a plurality of holes formed therethrough each for receiving an electrical connector pin, and further including a bridge extending between the first and second block members so that the bridge rides on the beam separating the pair of the elongated through holes. The second block member also includes lock arms extending therefrom for engaging a lock shoulder are formed in the die cast metal housing to secure the insert in the first housing.

In another embodiment of the invention the insert pre-stage locking element also includes a second elongated lock finger constructed in the mirror image of the first lock finger so that the insert pre-stage locking member may be snap fitted into the first connector housing in either of two orientations.

In another embodiment of the invention, the base portion of the first connector housing includes two pairs of the elongated through holes formed therein and electrical terminal pins extending through each of the through holes. Two insert pre-stage locking members are provide and are each received in an associated pair of elongated through holes. The second electrical connector housing includes two pairs of spaced apart elongated projections each having female terminals carried therein to engage electrical terminal pins extending through an associated through hole in the base of the first connector housing and wherein the lock shoulder on the second connector housing, mateable with one of the lock fingers, is positioned between a pair of spaced apart elongated projections.

These and other objects, features and advantages of the present invention will become apparent from the following brief description of the drawings, detailed description and appended claims and drawings.

DETAILED DESCRIPTION

Figure 1:
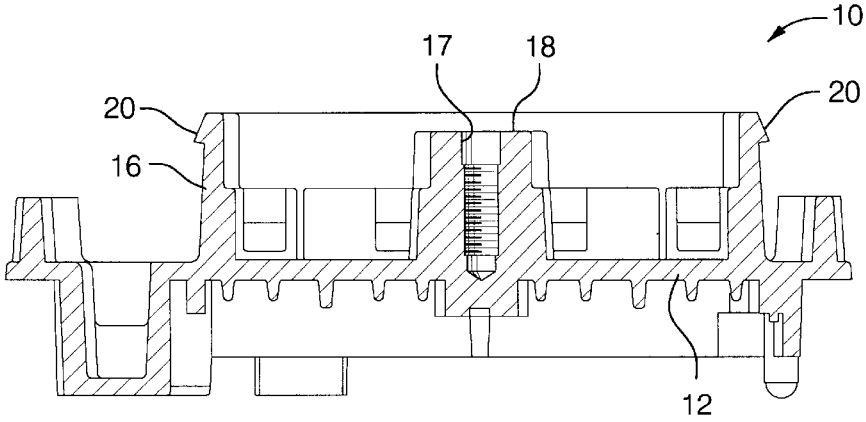
PRIOR ART FIG. 1
FIG. 1 is a sectional view of a die cast metal housing of the prior art having a locking ramp on an outer surface of the housing shroud.
Figure 2:
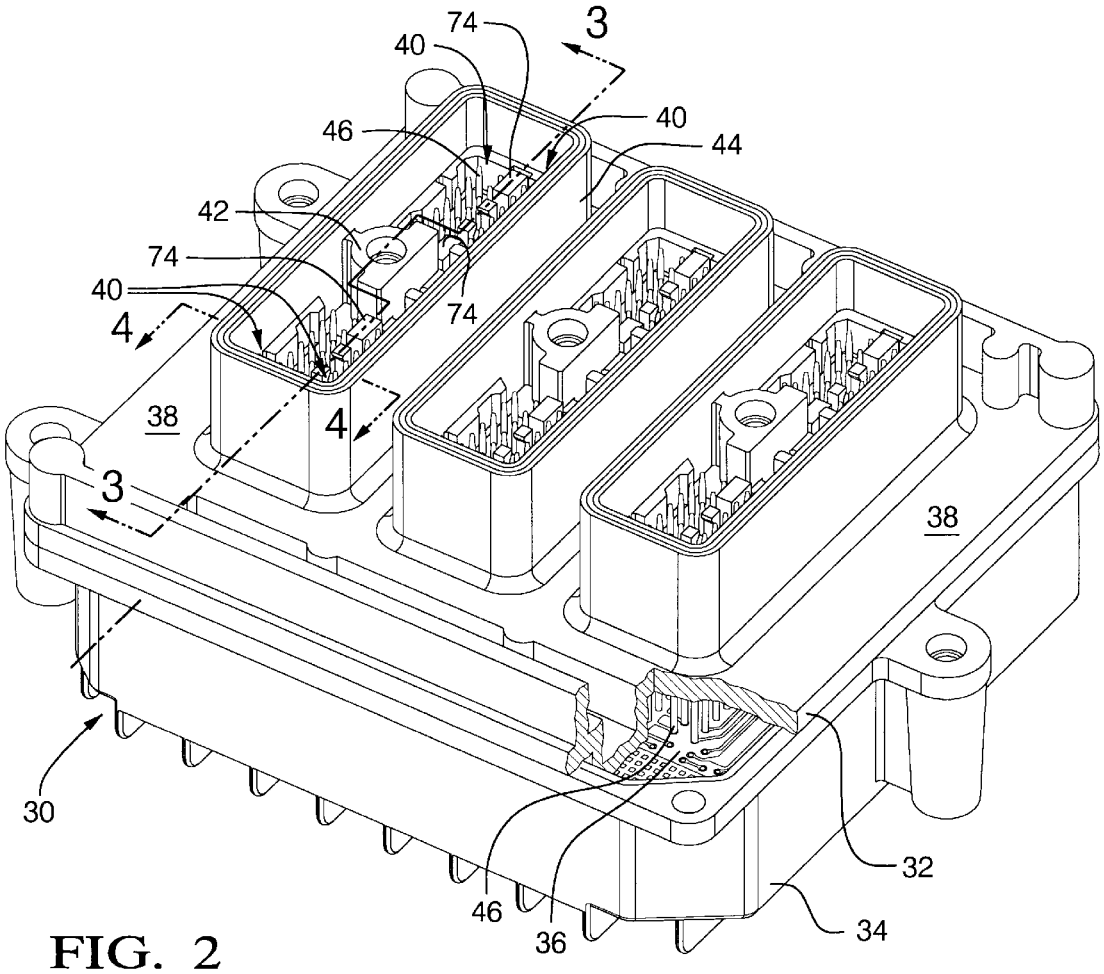
FIG. 2 is a perspective view of a connector system according to the present invention showing a first metallic housing having an insert pin retainer for locking to a second connector housing in a pre-staged position.
Figure 5:
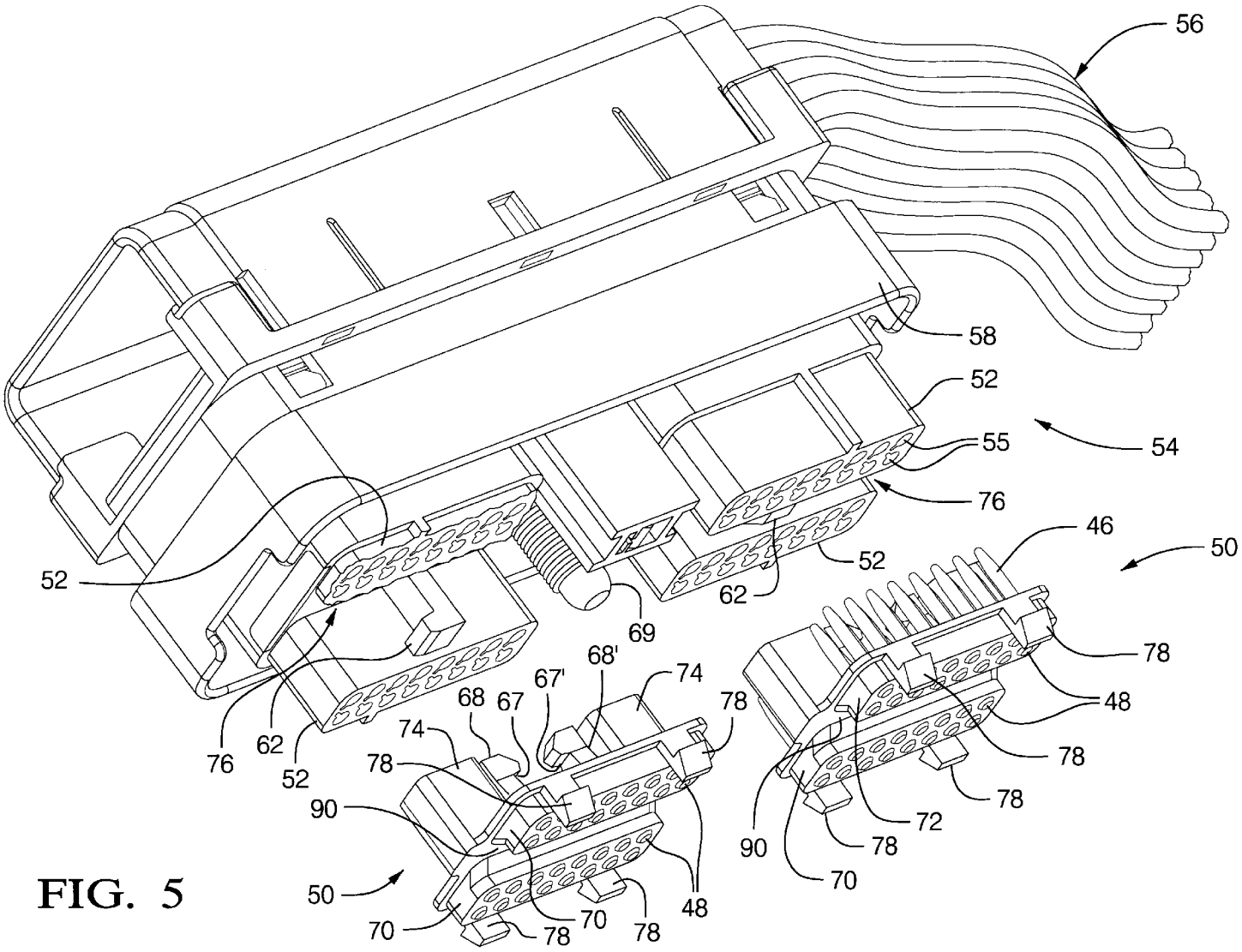
FIG. 5 is a perspective view of portions of connector system according to the present invention including an insert pin retainer mateable to a second connector housing.

Referring now to FIG. 2, an electrical connector system includes a first electrical connector housing 30 made form a die cast metal and which in this particular embodiment includes an upper portion 32 and a lower portion 34. The upper and lower portions 32, 34 carry and enclosed an electronic device inside, which in this case is a printed circuit board 36. The upper portion 32 of the first housing has a base 38 with a plurality of through holes 40 formed therein. The base 38 may have two pairs of elongated such through holes 40 that are separated by a mounting bridge 42. A shroud 44 extends from the base 38 to surround the four through holes 40. Electrical pins 46 extend from the printed circuit board and through alignment holes 48 (best shown in FIG. 5) formed in an electrical pin retainer 50, preferably made for a plastic material, that is snap fit into each pair of elongated through holes 40. The shroud forms a socket for receiving projections 52 of a second electrical connector housing 54 (FIG. 5). Each projection 52 carries a plurality of female terminals 55 each mateable with the an associated electrical pin 46. Each female terminal 55 is connected to an individual wire of a wire harness 56 attached to the second connector housing 54.

Figure 3:
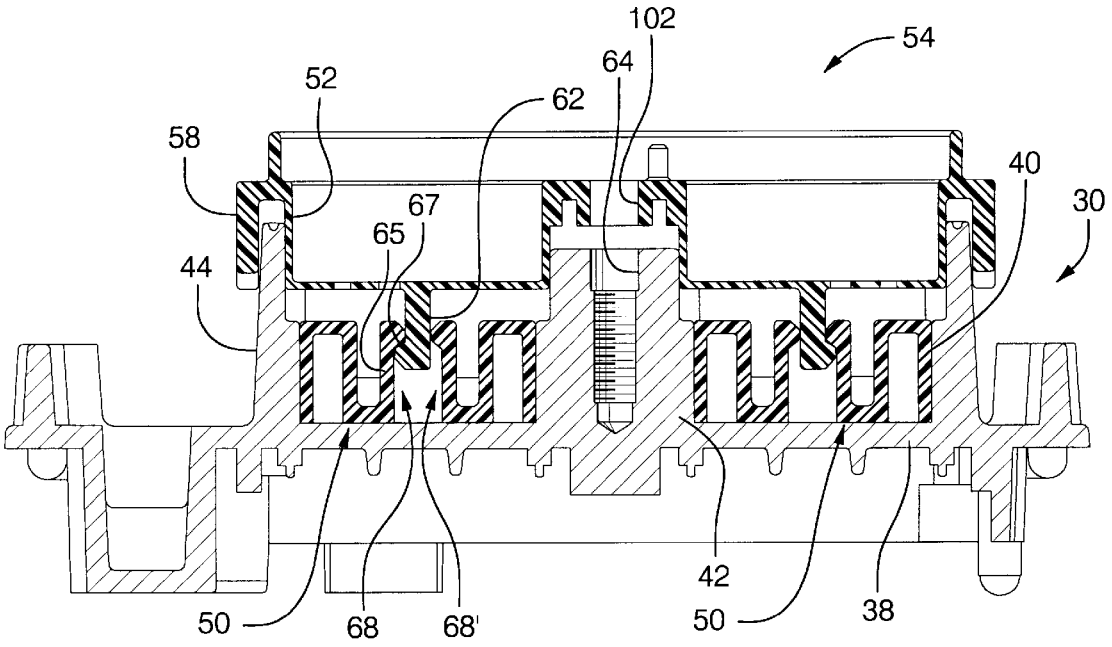
FIG. 3 is a sectional view of a connector system of FIG. 2 taken along lines 3—3 and illustrating a die cast housing with an insert pre-stage locking member according to the present invention.

Referring now to FIG. 3, it can be seen that the second electrical connector housing 54 includes a second shroud 58 space a distance from a portion of the projections 52 to define a channel therebetween constructed and arranged to receive a portion of the first shroud 44 of the first electrical connector housing.

The first connector 30 includes an insert pre-stage locking member 68 which in this case is a flexible locking finger that is a part of the pin retainer 50. The flexible locking finger 68 includes an elongated body portion 65 extending in the mating direction of the connectors and having a lock shoulder 67 extending at an angle, generally perpendicular to the mating direction of the connectors. The second electrical connector housing 54 includes a pre-stage locking member, preferably a first lock finger 62 extending between the projections 52.

The upper portion 32 of the first electrical connector housing includes a mounting bridge 42 extending from the base 38 and having a threaded through hole 64 for receiving a bolt 69 (shown best in FIG. 5) that also extends through a second housing through hole 102.

The pin retainer 50 with the pre-stage locking feature is snap fit (in a manner which will be described later) into the through holes 40 formed in the base 38 of the first die cast metal connector housing. The pin retainer 50 preferably includes a second locking finger 68' that is constructed in the mirror image of the first locking finger 68 so that the insert the pin retainer 50 can be snap fit into the first connector in either of two orientations for lockably engagement with the pre-stage locking member 62 of the second electrical connector housing 54.

Referring again to FIG. 5, the pin retainer 50 is shown separate from the first electrical connector housing 30 (which is omitted in FIG. 5 for clarity). The pin retainer 50 has a saddle like shape and that the pin retainer has a first and second elongated block 70,72 and a bridge 90 connecting the blocks 70, 72. Each block 70,72 includes a plurality of alignment holes 48 each for receiving an associated electrical pin 46 from the electronic device. Preferably the pin retainer 50 includes a first and second locking finger 68, 68' extending from the bridge 90 and having locking shoulders 67, 67' that face each other so that the pin retainer 50 can be positioned in the through holes 40 in either of two orientations as described above. Bent pin protection ribs 74 also extend from the bridge 90 of the pin retainer 50 in the mating direction of the connector housings to be received in an alignment channel 76 formed between projections 52 of the second connector housing 54. As will be appreciated from FIG. 5, the pre-stage locking member 62 of the second connector housing 54 is positioned in the channel 76 between two projections 52. Flexible lock arms 78 extend downward from the pin retainer 50 for locking against the first connector housing in a manner which will be described hereafter.

Figure 4:
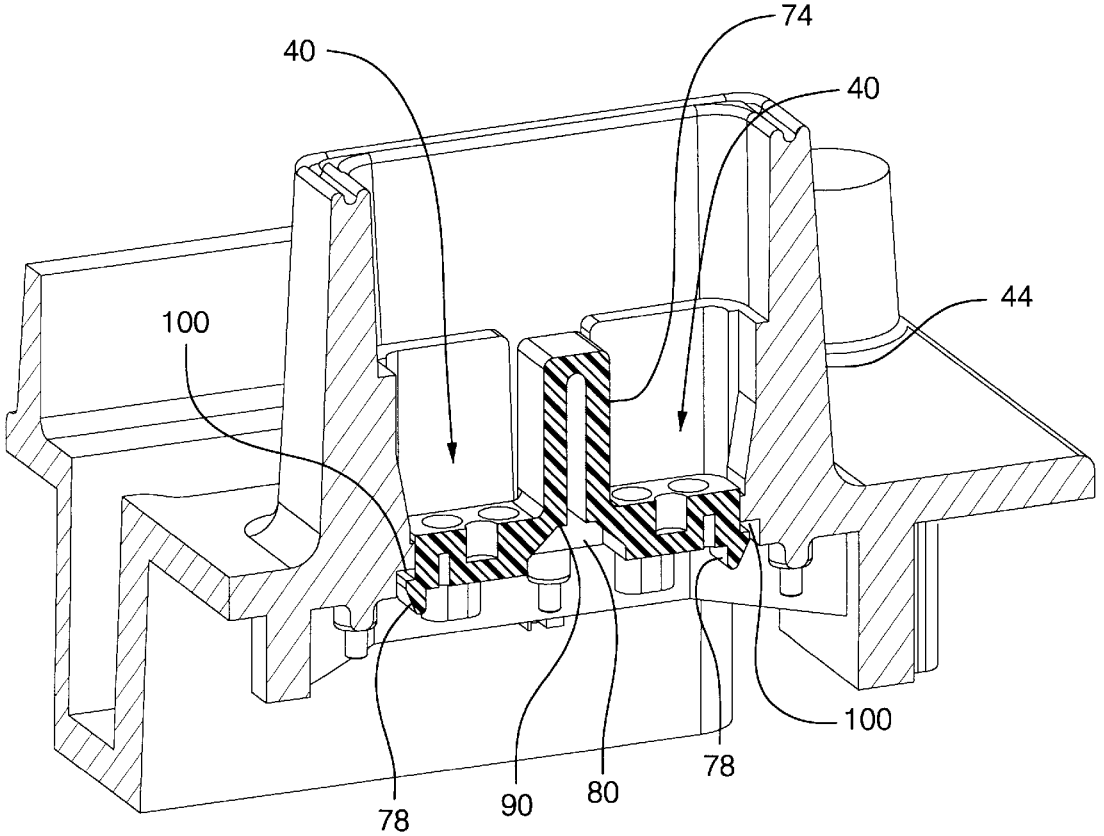
FIG. 4 is a sectional view of the die cast connector housing with the insert pin retainer taken along lines 4—4 of FIG. 2.

Referring now to FIG. 4, the first connector housing also includes a beam 80 that extends from the shroud 44 and divides the two elongated through holes 40. The bridge 90 of the saddle shaped pin retainer 50 rides on the beam 80 so that the flexible lock arms 78 lock against a shoulder 100 formed in the first housing at a lower end of the shroud 44, to lock the pin retainer in the first housing.

As will be appreciated from the foregoing, the expensive and time-consuming task of forming a lock ramp on the outer surface of the shroud is avoided with the present invention by utilizing a simple insert pre-stage locking member that is snap fit into the die cast metal housing and for engagement with a pre-stage locking member on the second connector housing. Further, the pre-stage lock arm is designed to allow the mating and unmating of the connectors housing without damaging the pre-stage lock arm. The present invention is particularly advantageous in that the pre-stage locking features are constructed and arranged to support a wire harness in an inverted position and to allow the primary lock features to be engaged without the operator having to physically hold the connector housings.

We claim:

1. An electrical connector system including a first and a second connector housing, the first connector housing made from a die cast metal, and wherein the first connector housing includes a base portion having a plurality of through holes formed therein and a shroud extending from the base portion and surrounding the plurality of through holes, the shroud defining a socket, the second connector housing including projections extending from the second connector housing in the mating direction of the connector housings and receivable in the socket, the projections having a plurality of female terminals, the first connector housing being connected to an electronic device having a plurality of electrical terminal pins extending through the through holes of the first connector housing for engaging the female terminals of the projections, and including an insert pre-stage locking member formed separate and distinct from the die cast first connector housing, the pre-stage locking member and the first connector housing having mutually engageable snap lock connecting features for mounting the pre-stage locking member with a snap fitted connection on the first connector housing in preparation for coupling with the second connector housing, said pre-stage locking member further having at least one elongated flexible locking finger extending in the mating direction of the connector housings presenting a locking shoulder extending at an angle to the mating direction of the connectors, and at least one associated locking shoulder provided on said second connector housing operative to couple the first and second connector housings in a pre-staged position, the first and second electrical connector housings further including alignment features to properly align the connectors and to prevent damage to the electrical terminal pins during mating of the connectors to a final position, and wherein the first and second connector housings include primary lock elements engageable upon movement of the connector housings to a final position in which the electrical terminal pins are fully engaged with the female terminals to lock the connector housings in the final position.

2. An electrical connector system as set forth in claim 1 wherein the insert pre-stage lock member further includes a first block member having a plurality of holes formed therein for receiving an associated one of the electrical terminal pins, and wherein the block member includes lock arms extending therefrom for engaging a lock shoulder formed in the first connector housing.

3. An electrical connector system as set forth in claim 2 wherein the first connector housing includes a first pair of elongated through holes separated by a beam, and wherein the insert pre-stage locking member further includes a second block member having a plurality of holes formed therethrough each for receiving an associated one of the electrical terminal pins, and further including a bridge extending between the first and second block members so that the bridge rides on the beam separating the pair of the elongated through holes, and wherein the second block member includes lock arms extending therefrom for engaging lock shoulders formed in the first connector housing.

4. An electrical connector system as set forth and claim 1 further comprising a second elongated lock finger constructed in the mirror image of the first lock finger so that the insert pre-stage locking member may be snap fitted into the first connector housing in either of two orientations.

5. An electrical connector system as set forth in claim 3 further comprising a second elongated lock figure constructed in the mirror image of the first lock finger so that the insert locking member may be snapped fitted into the first connector housing in either of two orientations.

6. An electrical connector system as set forth in claim 3 wherein the base portion of the first connector housing further includes a second pair of the elongated through holes formed therein and the electrical terminal pins extending through each of the through holes, and a second insert pre-stage locking member received in the second pair of elongated through holes, and wherein the second electrical connector housing includes two pairs of spaced apart elongated projections each having female terminals carried therein to engage the electrical terminal pins extending through associated through holes in the base, and wherein the lock shoulder on the second connector housing is positioned between a pair of spaced apart elongated projections.

7. An electrical connector system as set forth in claim 1 wherein the primary lock elements include a bolt extending through a passage in the second connector housing and into a bore in the first connector housing.

8. An electrical connector system as set forth in claim 6 wherein the primary lock elements include a bolt extending through a passage in the second connector housing and into a bore in the first connector housing.

9. An electrical connector system as set forth in claim 8 further comprising a mounting bridge extending from the base of the first connector and having the bore formed therein and separating the two pairs of through holes.

10. An electrical connector system including a first and second connector housing, the first connector housing made from a die cast metal, and wherein the first connector housing includes a base portion having a plurality of through holes formed therein and a shroud extending from the base portion and surrounding the plurality of through holes, the shroud defining a socket to receive a male portion extending from the second connector housing in the mating direction of the connector housings, and including an insert pre-stage locking member formed of plastics material separate and distinct from the die cast first connector features mutually engageable with associated snap lock connecting features of said first connector housing for securing the pre-stage locking member with a snap fitted connection to the first connector housing in preparation for coupling with the second connector housing, the pre-stage locking member further having at least one elongated flexible locking finger extending in the mating direction of the connector housings presenting a locking shoulder extending at an angle to the mating direction of the connectors for lockable engagement with an associated pre-stage locking member provided on the second connector housing operative to connect the first and second connector housing in the pre-staged position, and wherein the first and second connector housings include primary lock elements engageable upon movement of the connector housings to a final position in which the electrical terminal pins are fully engaged with the female terminals.

* * * * *